US008040067B2

(12) United States Patent
Sobieradzki

(10) Patent No.: US 8,040,067 B2
(45) Date of Patent: Oct. 18, 2011

(54) MAGNETRON WITH CATHODE DECOUPLED FROM OUTPUT

(75) Inventor: Edward Stanley Sobieradzki, Colchester (GB)

(73) Assignee: E2V Technologies (UK) Limited, Chelmsford (GB)

( * ) Notice: Subject to any disclaimer, the term of this patent is extended or adjusted under 35 U.S.C. 154(b) by 282 days.

(21) Appl. No.: 12/362,040

(22) Filed: Jan. 29, 2009

(65) Prior Publication Data

US 2009/0189527 A1 Jul. 30, 2009

(30) Foreign Application Priority Data

Jan. 30, 2008 (GB) ..... 0801708.9

(51) Int. Cl.
*H01J 23/36* (2006.01)

(52) U.S. Cl. ..... 315/39.53; 315/39.51; 315/39.69

(58) Field of Classification Search ..... 315/39.51, 315/39.53, 39.67, 39.69, 39.73, 39.75, 39.77
See application file for complete search history.

(56) References Cited

U.S. PATENT DOCUMENTS 3,315,121 A * 4/1967 Staats ..... 315/39.51
5,003,223 A * 3/1991 Oguro ..... 315/39.75
5,350,905 A * 9/1994 Choi ..... 315/39.53
6,841,940 B2 7/2003 Brady et al.
7,026,761 B2 8/2003 Saleem et al.
7,135,820 B2 * 11/2006 Shon et al. ..... 315/39.51
2001/0052825 A1 12/2001 Saleem et al.

FOREIGN PATENT DOCUMENTS

EP 1 316 984 A2 6/2003
GB 2377816 A * 1/2003

OTHER PUBLICATIONS

"Neutralizing Pegs," Crossed-Field Microwave Devices, vol. 2, Academic Press, New York, Long Anode Magnetrons by H.A.H. Boot, pp. 269-271.
United Kingdom Search Report issued in Application No. GB081708.9 Dated May 21, 2008.

* cited by examiner

*Primary Examiner* — Jacob Y Choi
*Assistant Examiner* — Ephrem Alemu
(74) *Attorney, Agent, or Firm* — Venable LLP; Robert Kinberg; Christopher Ma

(57) ABSTRACT

A magnetron including a cathode, an anode axially aligned with the cathode and including a plurality of radial vanes defining resonant cavities, an output coupler connected to a first set of the vanes, a second set of vanes not connected to the output coupler, and extensions formed on only the vanes of the second set, the extensions extending in the axial direction towards the output coupler in a direction parallel to the axis of the anode, the extensions not being connected to the output coupler, whereby a capacitance between the axial extensions and the cathode at least partly compensates for the capacitance between the output coupler and the cathode.

7 Claims, 2 Drawing Sheets

MAGNETRON WITH CATHODE DECOUPLED FROM OUTPUT

CROSS-REFERENCE TO RELATED APPLICATION

This application claims the priority of GB 0801708.9, filed Jan. 30, 2008, the disclosure of which is incorporated herein by reference, along with each U.S. and foreign patent and patent application mentioned below.

BACKGROUND OF THE INVENTION

This invention relates to magnetrons.

The invention particularly relates to magnetrons having a coaxial output.

Thus, referring to FIG. 1 of the drawings, which is an axial section, partly in perspective, through a part of the vacuum chamber of a known magnetron, the output is taken from an output coupler in the form of aerial 1 which is coaxial with the axis of the magnetron. The magnetron has a cathode 2 arranged coaxially within an anode indicated generally by the reference numeral 3, which has the usual resonant cavities defined by vanes such as vanes 4, 10. The magnetron is operated in n mode, which means that, referring to FIG. 2, which is a section taken through the lines 2-2 in FIG. 1 but omitting the vanes in one half of the magnetron, alternate vanes 4, 6, 8, 10 have one polarity, and intervening vanes 5, 7, 9 have the opposite polarity. The aerial is fed through legs 11 connected to the bottom (as seen in FIG. 1) of the equipotential vanes 5, 7, 9. The aerial 1 launches the magnetron output along output line 12, with the electric vector being developed across the slot 13 surrounding the stub 14 of the aerial.

A problem with such a magnetron is that there are high r.f. fields between the lower end (as seen in FIG. 1) of the cathode termed the "end hat" 15, and the upper face of the output coupler (aerial 1), due to capacitive coupling between the two parts. The anode is usually held at earth potential, and the cathode usually held at a large negative dc potential.

Such capacitive coupling introduces the coaxial TEM mode between the anode 3 and the cathode 2. RF energy can then propagate out of the magnetron by travelling along the cathode 2, resulting in loss of power in the desired n mode, generation of undesirable radiation from the magnetron, and high voltages between the cathode and internal structures, which could result in arcing.

To minimise creation of the coaxial TEM mode, the magnetron is provided with radial extensions 16 to the alternate vanes 4, 6, 8, 10 that are not connected by legs to the aerial 1. Such "neutralising pegs" were proposed in Crossed-Field Microwave Devices, Volume 2, 1961, Academic Press, New York, Long Anode Magnetrons by H. A. H Boot, page 269-271.

The pegs introduce capacitance between the end hat 15 of the cathode and the pegs themselves. However, the r.f. field induced between the end hat 15 of the cathode and the pegs 16 is of opposite polarity to the r.f. field induced between the end hat and the aerial (since the latter is connected to the vanes 5, 7, 9 of opposite polarity). This results in the cathode being decoupled from the output (in this case, aerial 1).

The magnetron described above may have in known manner a ring or strap connected to the tops of the vanes 4, 6, 8, 10 at equipotential, as well as another to the tops of the intervening vanes, 5, 7, 9, which are also at equal potential to each other but opposite polarity to the vanes 4, 6, 8, 10, in order to improve the stability to the operation of the magnetron in the n mode. Such straps could be distributed along the length of the anode in a known manner (U.S. Pat. No. 6,841,940).

A disadvantage with the neutralising pegs described is that they could not be used at frequencies and power levels for which the distance between the peg and end hat was insufficient in terms of voltage breakdown. Nor could they be used in an arrangement in which the end hat of the cathode terminated below the ends of the anode vanes, again due to voltage breakdown considerations.

It is for this reason that an alternative solution to the problem of decoupling has been proposed (U.S. Pat. No. 7,026,761). Here a decoupling plate is located between the end hat of the cathode and an output coupling member. However, the decoupling plate has to be sized to be resonant at the operating frequency of the magnetron in order to decouple, but other factors might imply a different plate diameter.

SUMMARY OF THE INVENTION

The invention provides a magnetron comprising a cathode, an anode including a plurality of vanes defining resonant cavities, an output coupler connected to a first set of the vanes, and extensions on a second set of vanes not connected to the output coupler extending towards the output coupler in a direction parallel to the axis of the anode, whereby the capacitance between the axial extensions and the cathode at least partly compensates for the capacitance between the output coupler and the cathode.

Because the extensions are axial rather than radial as hitherto, it is possible to use them in magnetrons operating at higher frequencies and at higher power levels than those which use the neutralising pegs, as well as in magnetrons in which the end hat terminates below the ends of the anode vanes.

Advantageously, the vanes of the first set are of different polarity to the vanes of the second set, in use. The vanes of the first set may be arranged alternately with the vanes of the second set.

BRIEF DESCRIPTION OF THE DRAWINGS

The invention will now be described in detail, by way of example, with reference to the accompanying drawings, in which.

DETAILED DESCRIPTION

In all the drawings, the hatching lines should be ignored.

Figure 1:
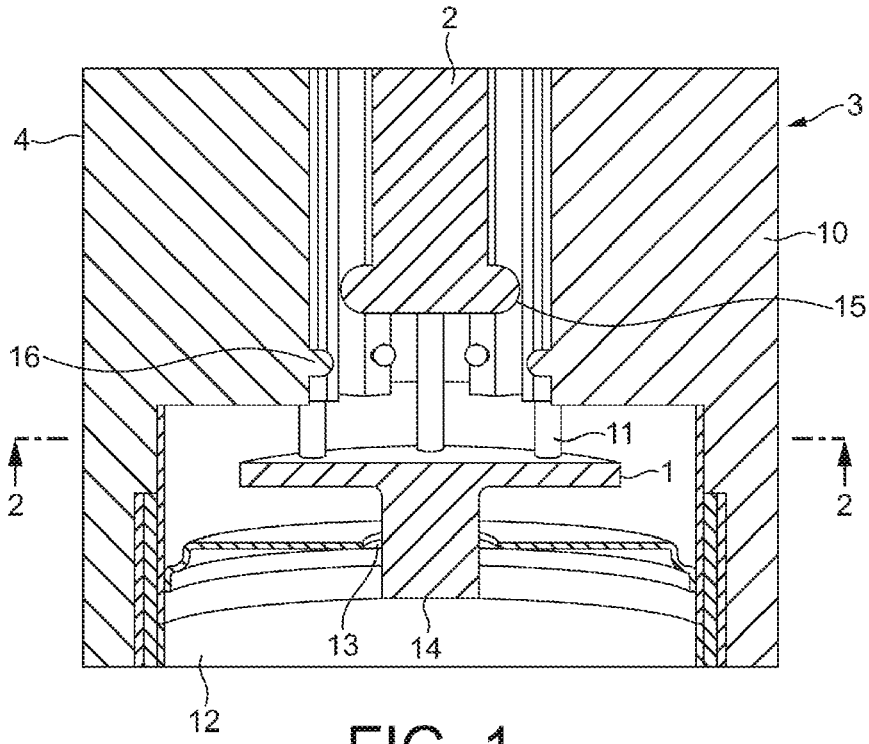
FIG. 1 Prior Art
FIG. 1 is an axial section, partly in perspective, through a part of the vacuum chamber of a known magnetron valve.
Figure 2:
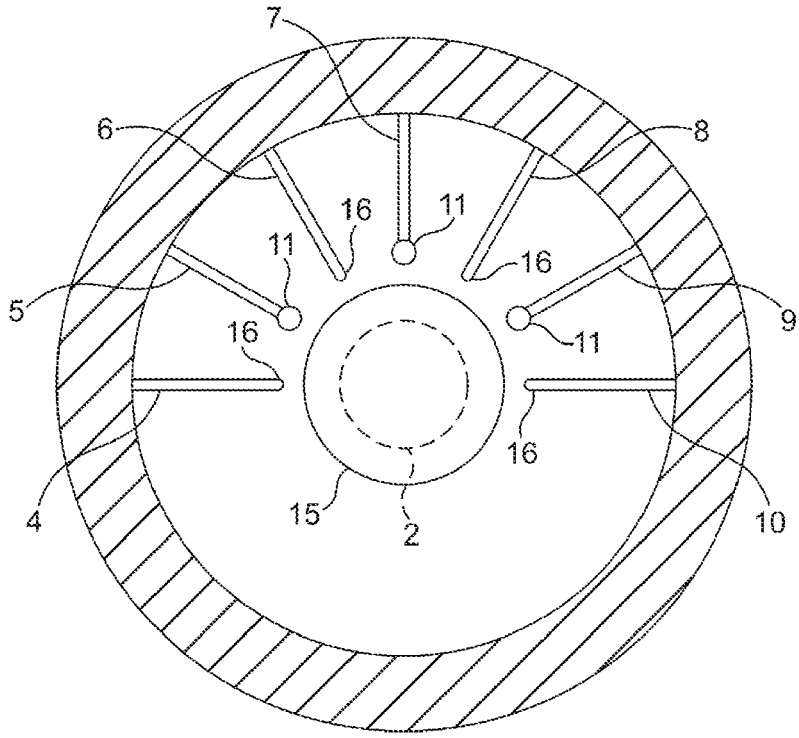
FIG. 2 Prior Art
FIG. 2 is a section taken through the lines 2-2 in FIG. 1 but only showing the vanes in one half of the anode.
Figure 3:
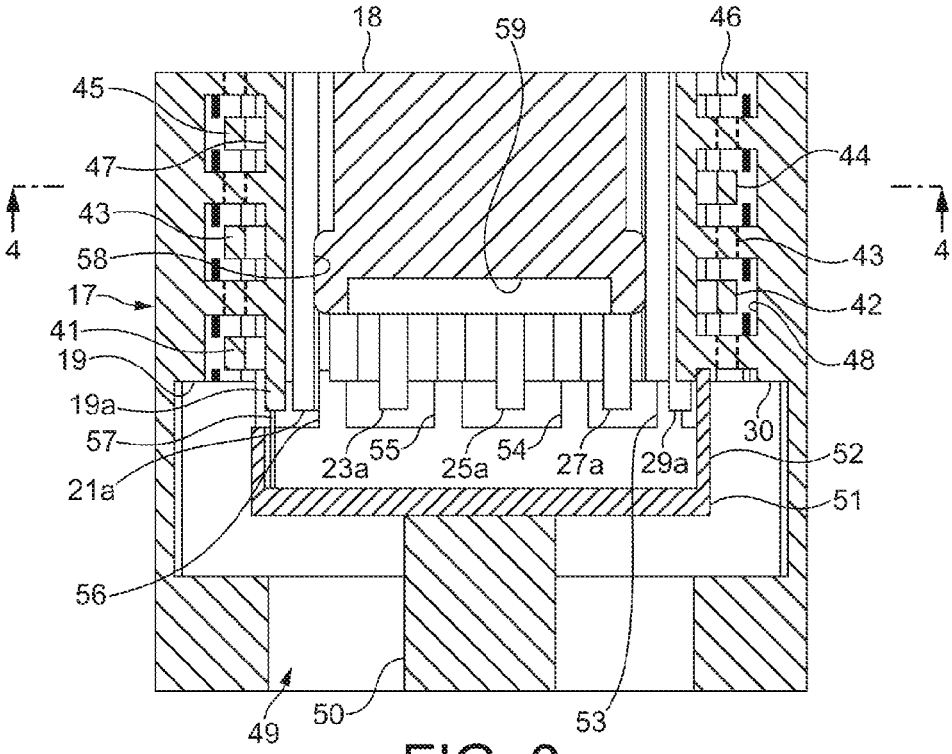
FIG. 3 is an axial section through a part of the vacuum chamber of a magnetron valve in accordance with the invention.
Figure 4:
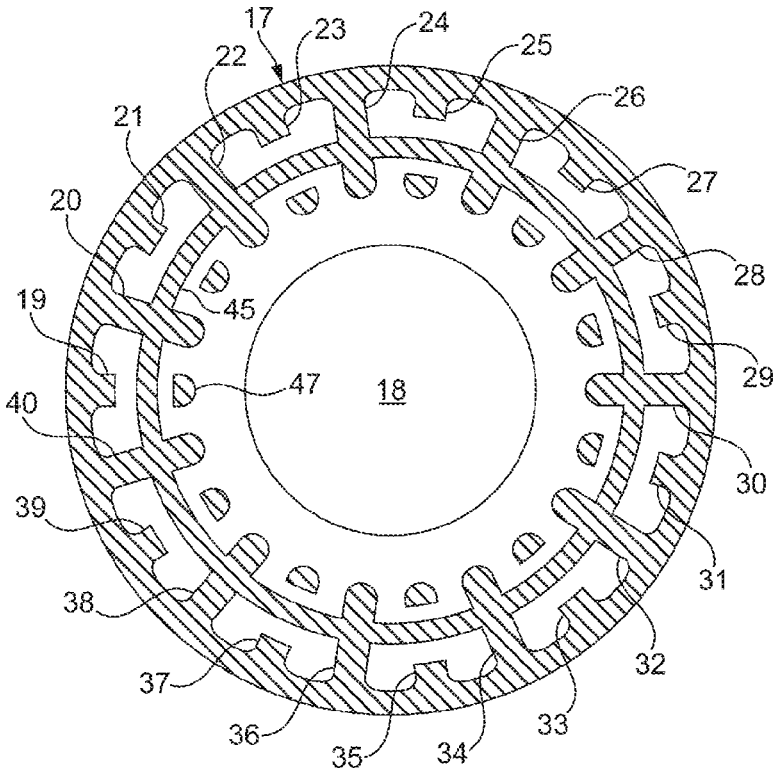
FIG. 4 is a section taken through the lines 4-4 in FIG. 3.

Referring to FIGS. 3 and 4, the magnetron of the invention includes an anode indicated generally by the reference numeral 17 and a cathode 18 arranged coaxially with respect to the anode. Magnets to generate the axial field are not shown. Resonant cavities are defined in the anode by means of vanes 19 to 40 (FIG. 4). Strap rings 41 to 46 are distributed along the length of the anode.

Strap rings 41, 43, 45 are connected to the set of vanes with even reference numerals (20 to 40) to maintain them at the same polarity as each other. The strap rings pass through apertures in the alternate vanes 19 to 39, and are not connected to them. The aperture through which the strap ring 41 passes through vane 19 has the reference numeral 47, but the other apertures have not been given reference numerals. The strap rings are connected to the vanes 20 to 40 by brazing, and so their outline is shown dotted (such as with strap ring 43) where they pass through vane 30, which lies in the plane of FIG. 3. Strap rings 42, 44, 46 are connected to the set of vanes with odd reference numerals (19 to 39), and pass through apertures in the even-numbered vanes 20 to 40, one of the apertures being given the reference numeral 48. Odd-numbered vanes 19 to 39 are also held at the same polarity as each other, but opposite to the polarity at which even-numbered vanes are held. There are further strap rings distributed along the part of the length of the anode which is not shown. Thus, if the polarity of the instantaneous electromagnetic field at the tips (inner edges) of vanes 19 to 39 is 0°, the polarity of the tips of the vanes 20 to 40 is 180°. The inner ends of all the vanes 19 to 41 are rounded. The strap rings increase the frequency separation of the wanted n mode and the unwanted n-1 mode in a known manner.

R.f. power is coupled from the magnetron coaxially, via a connection to the lower end of a set of vanes (as seen in FIG. 3). The r.f. radiation propagates along a coaxial line indicated generally by the reference numeral 49. The centre conductor 50 of the coaxial line is connected to output coupler 51, which is a cup-shaped member which connects to the even-numbered set of vanes 20 to 40 by respective axial legs 52 to 57. These vanes 20 to 40 are all at the same potential relative to each other.

The proximity of the output coupler 51 and the enlarged, lower-end of the cathode 18, termed the "end hat" 58 results in a coupling capacitance between the two components. The end hat 58 has a cylindrical recess 59.

In accordance with the invention, the lower end of the inner edge (as seen in FIG. 3) of each of the set of vanes that are not connected to the output coupler, that is, odd-numbered vanes 19 to 39 has an axial extension. Axial extensions 19*a*, 21*a*, 23*a*, 25*a*, 27*a*, 29*a* can be seen in FIG. 3. There is capacitive coupling between these vane extensions and the cathode 18. The length of the extensions is chosen so that the capacitive coupling is approximately the same as the capacitive coupling from the cathode to the output coupler 51. Because the vanes 19 to 39 are alternate with the vanes 20 to 40 and are at an equal potential and opposite polarity, this results in the output coupler 51 being substantially decoupled from the cathode 18.

In a second embodiment of the invention (not illustrated), the cathode is of increased axial length, such that the end hat 58 extends into the output coupler 51. Decoupling nevertheless takes place also in this arrangement.

Variations are possible without departing from the scope of the invention. Thus, for example, the extensions 19*a* etc are positioned at the tip, that is, the inner edge, of each vane. However, the axial extension could be at any radial position on the vane, and could even be on its edge of greatest diameter, that is, its outermost edge. Further, it is not necessary for all the equipotential vanes to have extensions. Some only, for example, every other one of these vanes 19 to 39 could have the axial extensions. Equally, it is not necessary for all the vanes of opposite potential 20 to 40 to be provided with legs to connect to the output coupler 51. Some only of these vanes, for example, every other one, could be provided with legs to connect to the output coupler.

The magnetron described is a distributed strapped anode magnetron, and the anode may be a segmented structure of any of the forms described in U.S. Pat. No. 6,841,940. However, the invention is also applicable to magnetrons which employ only one pair of straps, each strap provided for holding respective alternate vanes at the same potential as each other and opposite to the potential of adjacent vanes. The invention is further applicable to magnetrons which have just a single strap ring so that one set of alternate vanes are connected whereas the interspersed vanes are not, and to designs where only one set of alternate vanes are connected, but strap rings are distributed along the length of the anode. The invention is also applicable to magnetrons which do not have any strap rings at all.

Magnetrons according to the invention may operate at any frequency within the range 0.1 GHz to 0.5 THZ, preferably within the band from 8 to 12 GHz. The output is preferably 1 MW or greater.

The invention claimed is:

1. A magnetron comprising a cathode, an anode axially aligned with the cathode and including a plurality of radial vanes defining resonant cavities, an output coupler connected to a first set of the vanes, a second set of vanes not connected to the output coupler, and extensions formed on only the vanes of the second set, said extensions extending in the axial direction towards the output coupler in a direction parallel to the axis of the anode, the extensions not being connected to the output coupler, whereby a capacitance between the axial extensions and the cathode at least partly compensates for the capacitance between the output coupler and the cathode.

2. A magnetron as claimed in claim 1, in which the axial extensions are at the tips of the anode vanes.

3. A magnetron as claimed in claim 1, in which the magnetron has one or more strap rings connected to one set of the vanes.

4. A magnetron as claimed in claim 3, in which there are a plurality of rings connected to the same set of vanes and distributed over the length of the anode.

5. A magnetron as claimed in claim 4, in which the vanes of one set alternate with the vanes of the other set.

6. A magnetron as claimed in claim 5, in which the output coupler is connected to a coaxial output line.

7. A magnetron as claimed in claim 6, in which the frequency output lies within a range of from 8 to 12 GHz.

* * * * *